US011312523B2

(12) United States Patent
Yamaguchi et al.

(10) Patent No.: US 11,312,523 B2
(45) Date of Patent: Apr. 26, 2022

(54) SYNTHETIC RESIN-MADE MULTILAYER CONTAINER

(71) Applicants: HOKKAI CAN CO., LTD., Otaru (JP); KIKKOMAN CORPORATION, Noda (JP)

(72) Inventors: Akihiro Yamaguchi, Gunma (JP); Natsuyuki Mannen, Chiba (JP); Denmi Kuwagaki, Chiba (JP)

(73) Assignees: Hokkai Can Co., Ltd., Hokkaido (JP); Kikkoman Corporation, Chiba (JP)

( * ) Notice: Subject to any disclaimer, the term of this patent is extended or adjusted under 35 U.S.C. 154(b) by 108 days.

(21) Appl. No.: 16/652,807

(22) PCT Filed: Oct. 12, 2018

(86) PCT No.: PCT/JP2018/038069
§ 371 (c)(1),
(2) Date: Apr. 1, 2020

(87) PCT Pub. No.: WO2019/093068
PCT Pub. Date: May 16, 2019

(65) Prior Publication Data

US 2020/0231321 A1 Jul. 23, 2020

(30) Foreign Application Priority Data

Nov. 8, 2017 (JP) ..... JP2017-215968

(51) Int. Cl.
*B65D 1/02* (2006.01)
*B65D 79/00* (2006.01)
(Continued)

(52) U.S. Cl.
CPC ..... *B65D 1/0215* (2013.01); *B65D 1/0246* (2013.01); *B65D 23/02* (2013.01);
(Continued)

(58) Field of Classification Search
CPC ..... B65D 1/0215; B65D 83/0055; B65D 83/0061; B65D 79/005; B54D 23/02; B54D 25/16
(Continued)

(56) References Cited

U.S. PATENT DOCUMENTS 5,044,524 A * 9/1991 Pistek ..... B65D 83/0061 222/212
9,387,951 B2 * 7/2016 Miyajima ..... B29C 49/4273
(Continued)

FOREIGN PATENT DOCUMENTS

JP H06-039906 A 2/1994
JP 2010-082916 A 4/2010
(Continued)

OTHER PUBLICATIONS

Office Action issued in the corresponding Chinese Patent Application No. 201880072155.2 with the English translation thereof, dated Jun. 29, 2021.

*Primary Examiner* — Don M Anderson
*Assistant Examiner* — Jennifer Castriotta
(74) *Attorney, Agent, or Firm* — Carrier Blackman & Associates, P.C.; William D. Blackman; Joseph P. Carrier

(57) ABSTRACT

A synthetic resin-made multilayer bottle includes: an outer shell bottle having a shoulder section continuing from an outer opening section, and a body section continuing from the shoulder section; a synthetic resin-made inner container body having a cylindrical inner opening section provided inside the outer opening section of the outer shell bottle, and an inner container main body continuing from the inner opening section, shaped along an inner surface shape of the outer shell bottle, which deforms by an external pressure; and an air passage formed between the outer opening section and the inner opening section and which introduces outside air between the outer shell bottle and the inner container
(Continued)

body. The inner circumferential surface of the inner opening section is provided with a small-diameter section having a diameter smaller than the inner diameter of the open end of the inner opening section.

2 Claims, 6 Drawing Sheets

(51) Int. Cl.
*B65D 83/00* (2006.01)
*B65D 23/02* (2006.01)
*B65D 25/16* (2006.01)

(52) U.S. Cl.
CPC ..... *B65D 25/16* (2013.01); *B65D 79/005* (2013.01); *B65D 83/0055* (2013.01)

(58) Field of Classification Search
USPC ..... 215/11.3, 12.1; 220/62.21
See application file for complete search history.

(56) References Cited

U.S. PATENT DOCUMENTS

| | | | | |
|---|---|---|---|---|
| 2015/0210524 | A1 | 7/2015 | Witte et al. | |
| 2017/0313462 | A1* | 11/2017 | Taruno ..... | B65D 83/0055 |

FOREIGN PATENT DOCUMENTS

| | | | |
|---|---|---|---|
| JP | 2013-245010 | A | 12/2013 |
| JP | 2017-030846 | A | 2/2017 |
| WO | 2017/164225 | A1 | 9/2017 |

* cited by examiner

FIG.3C
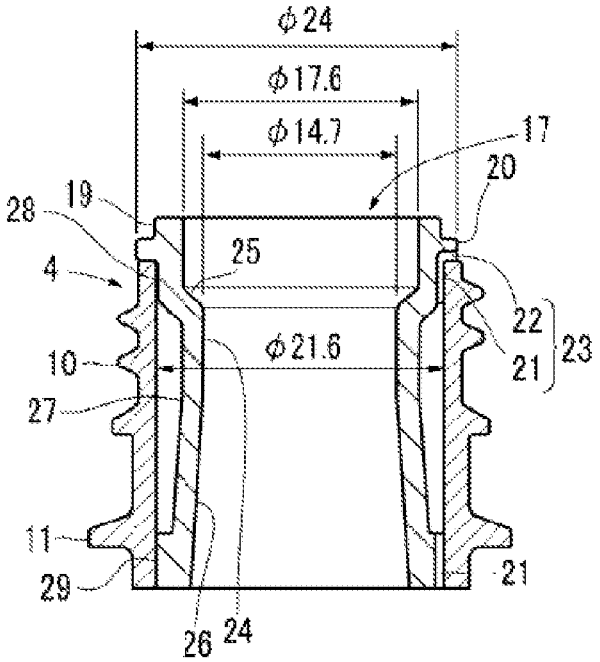
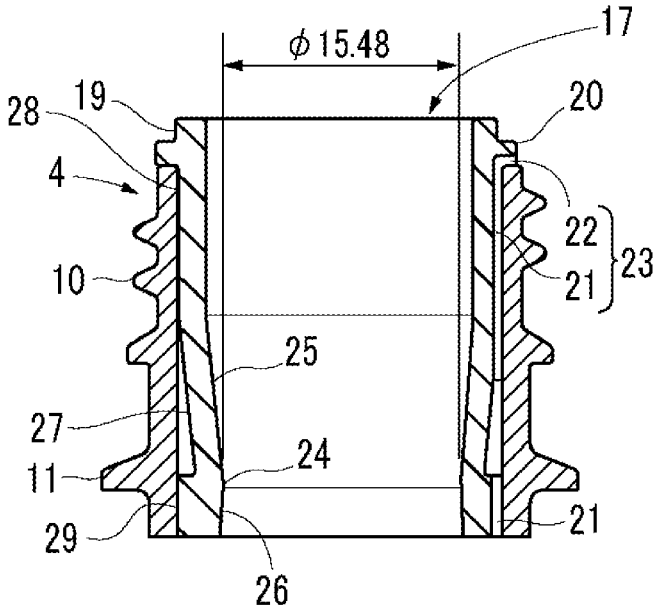
FIG.4

SYNTHETIC RESIN-MADE MULTILAYER CONTAINER

TECHNICAL FIELD

The present invention relates to a synthetic resin-made multilayer container provided with an inner container body disposed in an outer shell bottle.

BACKGROUND ART

Hitherto, there has been known a synthetic resin-made multilayer bottle in which an inner container body that deforms due to a volume reduction caused by an external pressure (hereinafter referred to as "the volume reduction deformation" in some cases) is placed inside an outer shell bottle capable of restoring the original shape thereof in response to an external pressure, and outside air is introduced between the outer shell bottle and the inner container body (refer to, for example, Japanese Patent Application Laid-Open No. 2013-245010 and Japanese Patent Application Laid-Open No. 2010-082916).

In the synthetic resin-made multilayer bottle, a content held in the inner container body is poured out by pressing a body section of the outer shell bottle thereby to deform the inner container body by volume reduction. Meanwhile, when the pressing pressure is released, outside air is introduced between the outer shell bottle and the inner container body by the action of a check valve or the like that is separately provided. As a result, an external air pressure causes the outer shell bottle to restore the original shape thereof, while the inner container body is maintained in the state of the volume reduction deformation. At this time, the outside air does not enter into the inner container body, thus preventing the content held in the inner container body from deteriorating due to oxidation or the like.

CITATION LIST

Patent Literatures

Patent Literature 1: Japanese Patent Application Laid-Open No. 2013-245010

Patent Literature 2: Japanese Patent Application Laid-Open No. 2010-082916

SUMMARY OF INVENTION

Technical Problem

When an attempt is made to squeeze a content thoroughly out of a multilayer container, if a hollow space that remains when the volume reduction deformation of an inner container body of the multilayer container reaches a limit, i.e. a hollow space that cannot be eliminated (hereinafter referred to as "the dead space"), is larger than a space where a gas exists after the content is charged (hereinafter referred to as "the head space"), then a problem arises that the content in the dead space cannot be thoroughly squeezed out by the volume of the gas in the head space. Hence, it is desired to set the dead space to be smaller than the head space in order to thoroughly squeeze out the content.

In particular, an outer opening section of the outer shell bottle and an inner opening section of the inner container body are the places where a cap or the like is provided and these parts are not deformed by an external pressure. Hence, it is possible to reduce the internal volumes of the outer opening section and the inner opening section to reduce the dead space.

However, the outer circumferential surface of the outer opening section of the outer shell bottle is a place where an external thread is formed, onto which a cap with a check valve or the like is screwed, so that there is a limit in making the outer opening section smaller from the viewpoint of specifications.

In view of the above background, an object of the present invention is to provide a synthetic resin-made multilayer bottle that can reduce a dead space without being affected by the specifications of an outer opening section.

Solution to Problem

[1] To this end, the present invention provides a synthetic resin-made multilayer bottle including:

a synthetic resin-made outer shell bottle which has a cylindrical outer opening section, a shoulder section continuing from the outer opening section, a body section continuing from the shoulder section, and a bottom section continuing from the body section, and which can restore an original shape thereof with respect to an external pressure;

a synthetic resin-made inner container body which has a cylindrical inner opening section provided inside the outer opening section of the outer shell bottle, and an inner container main body which continues from the inner opening section, which is shaped along an inner surface shape of the outer shell bottle, and which deforms in response to an external pressure; and an air passage which is formed between the outer opening section and the inner opening section and which introduces outside air between the outer shell bottle and the inner container body, wherein a small-diameter section having a diameter that is smaller than an inner diameter of an open end of the inner opening section is provided on an inner circumferential surface of the inner opening section.

According to the present invention, the small-diameter section reduces the volume of the inner opening section, thus making it possible to provide a synthetic resin-made multilayer bottle with a smaller dead space. In addition, the volume of the inner opening section can be reduced without reducing the outer diameter of the outer opening section, so that the dead space can be reduced by reducing the volume of the inner opening section while maintaining the diameter of the outer opening section that conforms to specifications.

Further, the open end of the inner opening section is formed to have a diameter that is larger than the small-diameter section, so that despite the reduced volume of the inner opening section, a blow molding nozzle or a content charging nozzle can be easily inserted into the inner opening section at the time of blow molding or charging the content.

[2] Further, in the present invention, preferably, wherein at least a part of an upper end outer circumferential surface of the inner opening section excluding a part that forms the air passage is an upper end contact part that is in contact with an inner circumferential surface of the outer opening section, a separated part spaced away from the inner circumferential surface of the outer opening section is provided on an outer circumferential surface of the inner opening section, and positioned in an area, which corresponds to the small-diameter section, at the bottom of the upper end contact part, and the separated part is spaced away farther inward in a radial direction than the air passage, thereby forming a hollow space.

According to the configuration described above, the volume of the inner opening section can be reduced without reducing the outer diameter of the outer opening section, so that the dead space can be reduced by reducing the volume of the inner opening section while maintaining the diameter of the outer opening section conforming to the specifications thereof.

In addition, the hollow space other than the air passage can be formed to be relatively large by providing the separated part at a position in the area corresponding to the small-diameter section between the outer circumferential surface of the inner opening section and the inner circumferential surface of the outer opening section, spacing the separated part away farther inward in the radial direction than the air passage. This makes it possible to reduce the amount of a resin for the inner opening section thereby to achieve cost reduction. In addition, the upper end contact part of the inner opening section is in contact with the inner circumferential surface of the outer opening section, thus making it possible to prevent the inner opening section from rattling at the time of blow molding or handling of the multilayer bottle thereafter.

[3] Further, in the present invention, preferably, at least a part of a lower end outer circumferential surface of the inner opening section excluding a part that forms the air passage is a lower end contact part that is in contact with an inner circumferential surface of the outer opening section.

According to the configuration described above, the volume of the inner opening section can be reduced without reducing the outer diameter of the outer opening section, so that the dead space can be reduced by reducing the volume of the inner opening section while maintaining the diameter of the outer opening section conforming to the specifications thereof.

Further, the lower end contact part of the inner opening section is in contact with the inner circumferential surface of the outer opening section, thus enabling the inner opening section to be fixed to the outer opening section in a stable manner.

BRIEF DESCRIPTION OF DRAWINGS

FIG. 3C is a sectional view taken on line IIIC-IIIC of FIG. 3B;

FIG. 4 is an enlarged sectional view illustrating an outer opening section and an inner opening section of a synthetic resin-made multilayer bottle of a second embodiment of the present invention;

DESCRIPTION OF EMBODIMENTS

Figure 1:
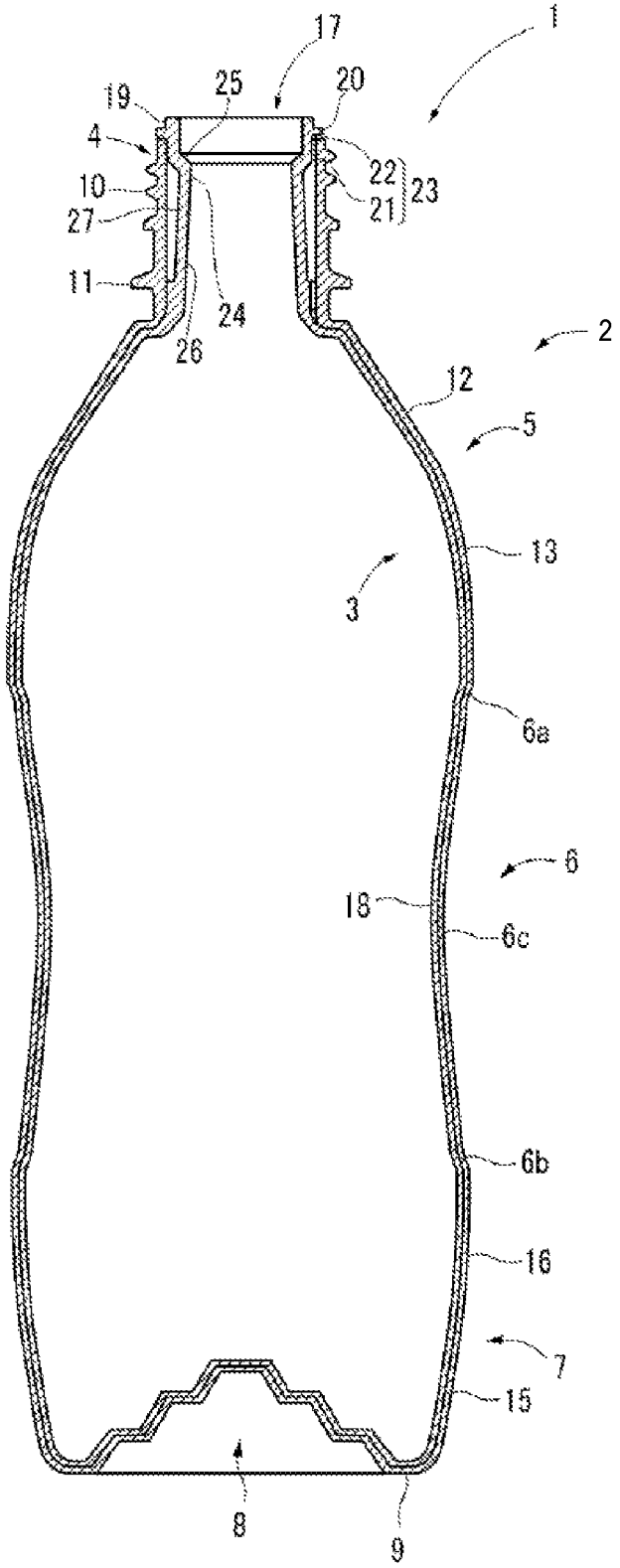
FIG. 1 is a sectional view illustrating a first embodiment of a synthetic resin-made multilayer bottle in accordance with the present invention.
Figure 2:
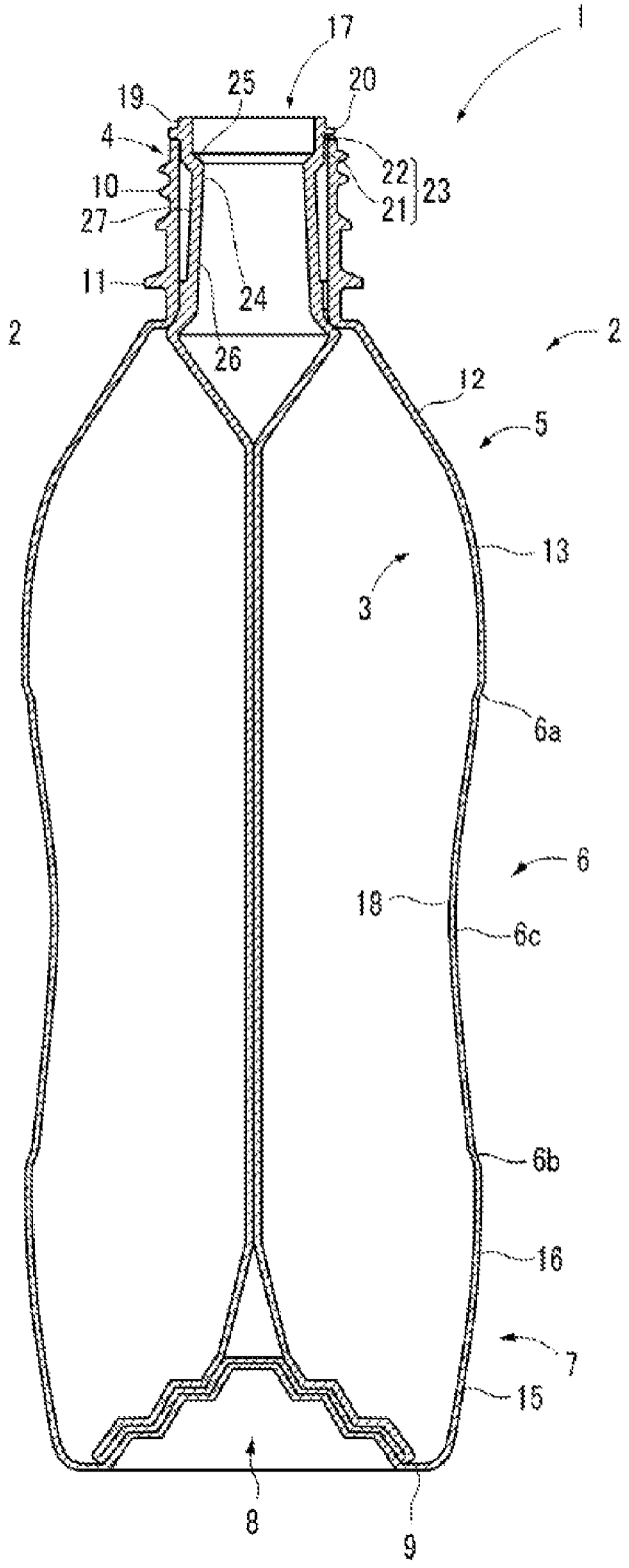
FIG. 2 is an explanatory diagram illustrating a dead space of an inner container main body of the synthetic resin-made multilayer bottle of the first embodiment.

Referring to FIG. 1 to FIG. 3A to FIG. 3C, a first embodiment of the synthetic resin-made multilayer bottle in accordance with the present invention will be described. As illustrated in FIG. 1 and FIG. 2, a synthetic resin-made multilayer bottle 1 of a first embodiment is composed of an outer shell bottle 2 capable of restoring its original shape with respect to an external pressure and an inner container body 3 which is housed inside the outer shell bottle 2 and which deforms in response to an external pressure. The outer shell bottle 2 and the inner container body 3 are made of, for example, a polyethylene terephthalate resin. The outer shell bottle 2 and the inner container body 3 may be formed of other polyester resin than the polyethylene terephthalate resin.

The outer shell bottle 2 has a cylindrical outer opening section 4, a shoulder section 5 continuing from the outer opening section 4, a body section 6 continuing from the shoulder section 5, and a bottom section 7 continuing from the body section 6. The bottom section 7 has, on the inner circumferential side, a recess section 8 which is recessed toward the inner side of the outer shell bottle 2 to impart independence to the synthetic resin-made multilayer bottle 1. A ground contact section 9 is located between the bottom section 7 and the recess section 8.

Figure 3A:
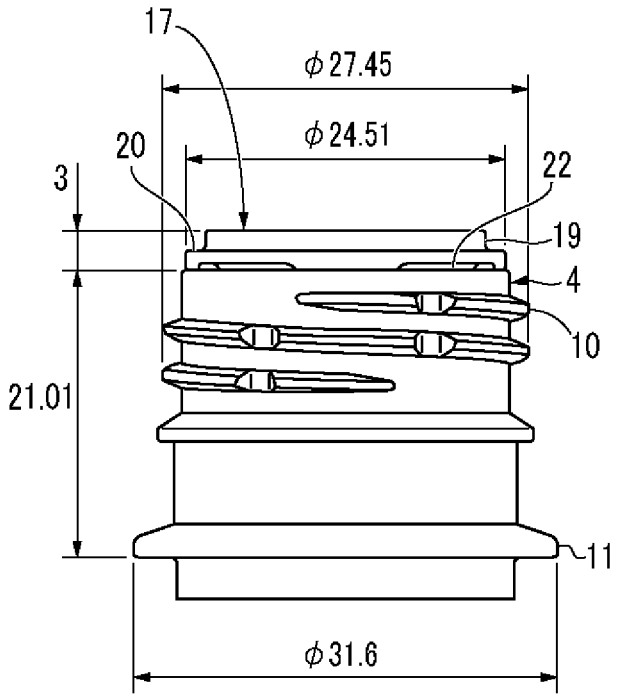
FIG. 3A is an enlarged front view illustrating an outer opening section and an inner opening section of the synthetic resin-made multilayer bottle of the first embodiment.
Figure 3B:
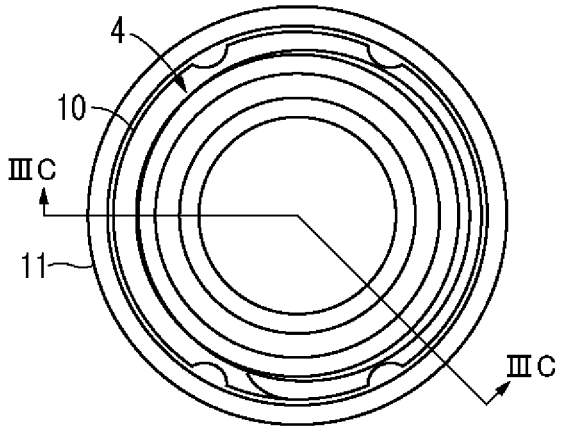
FIG. 3B is a plan view of the synthetic resin-made multilayer bottle of the first embodiment.

FIG. 3A is an enlarged front view illustrating the outer opening section 4 and an inner opening section 17. FIG. 3B is an enlarged plan view illustrating the outer opening section 4 and the inner opening section 17. FIG. 3C is a sectional view showing the outer opening section 4 and the inner opening section 17 taken on line IIIC-IIIC of FIG. 3B.

As illustrated in FIG. 3A to FIG. 3C, the outer opening section 4 is provided with an external thread section 10 and a support ring 11, which is positioned under the external thread section 10, on the outer circumferential surface, and a portion of the shoulder section 5 that is in contact with the outer opening section 4 has a quadrangular pyramid-shaped section 12. Provided at the bottom of the quadrangular pyramid-shaped section 12 is a body upper section 13, the diameter of which gradually increases from the quadrangular pyramid-shaped section 12 toward the body section 6 and in which the corners of the quadrangular pyramid become smoother and continue to the cylindrical body section.

The body section 6, the cross-section of which orthogonal to an axis is circular, continues from the shoulder section 5 via a first circumferential groove part 6*a* and also continues to the bottom section 7 via a second circumferential groove part 6*b*. Further, the body section 6 is shaped like a Japanese hand drum, in which the diameter gradually decreases from the lower end of the circumferential groove part 6*a*, which continues from the shoulder section 5, toward a central portion 6*c*, and gradually increases from the central portion 6*c* toward the upper end of the circumferential groove part 6*b* continuing to the bottom section 7. In addition, the body section 6 is provided with a plurality of vertical ribs, which extend in an axial direction over the entire circumference of the area shaped like a Japanese hand drum between the circumferential groove parts 6*a* and 6*b*.

In the bottom section 7, the portion thereof in contact with the ground contact section 9 is formed of a quadrangular pyramid-shaped section 15, and a body lower section 16 is provided on the upper side of the quadrangular pyramid-shaped section 15. The body lower section 16 has its diameter gradually increasing and its corners of the quadrangular pyramid becoming smoother from the quadrangular pyramid-shaped section 15 toward the body section 6, continuing to the cylindrical body section.

Further, the cross-section of each of the quadrangular pyramid-shaped sections 12 and 15, which cross-section is orthogonal to the axis, is quadrangular, and the vertices of the quadrangle are radiused and provided with ridge lines. The ridge lines are extended and continued.

Meanwhile, the inner container body 3 has the cylindrical inner opening section 17 provided on the inner circumferential side of the outer opening section 4, and an inner container main body 18 which continues to the inner opening section 17 and which is shaped along the inner surface shapes of the shoulder section 5, the body section 6, the bottom section 7, the recess section 8, and the ground contact section 9 of the outer shell bottle 2. The inner opening section 17 has thereon an extension section 19, which is extended upward beyond the upper end of the outer opening section 4. The extension section 19 is provided with a flange section 20 extended outward in the radial direction. The lower surface of the flange section 20 is in contact with the upper rim of the outer opening section 4, thereby locking the inner opening section 17 to the outer opening section 4.

Further, the inner opening section 17 is provided with a vertical groove 21 around the outer circumferential surface thereof. The vertical groove 21 is provided in a connected manner to a horizontal groove 22 formed at the lower surface of the flange section 20, and the horizontal groove 22 is opened to outside at the outer circumferential edge of the flange section 20. Thus, the vertical groove 21 and the horizontal groove 22 form an air passage 23, through which outside air is introduced, between the outer shell bottle 2 and the inner container body 3.

Further, the inner opening section 17 has, at a position spaced away from the upper rim thereof, a small-diameter section 24 having an inner diameter that is smaller than the inner diameter of the opening part. On the inner circumferential surface of the inner opening section 17, the small-diameter section 24 is connected to an upper inclined surface 25, the diameter of which gradually decreases at a tilt angle of approximately 45 degrees from a position spaced away with a predetermined interval from the upper rim. Further, there is a lower inclined surface 26, the diameter of which gently increases from the lower end of the small-diameter section 24 to the lower end of the inner opening section 17.

Further, in the present embodiment, the flange section 20, which extends outward in the radial direction and which has the lower surface thereof in contact with the upper end of the outer opening section 4, is provided at the upper end of the inner opening section 17. At least a part of the outer circumferential surface of the upper end area of the inner opening section 17 excluding an area corresponding to the air passage 23 forms an upper end contact section 28 (refer to FIG. 3) in contact with the inner circumferential surface of the outer opening section 4. On the lower side of the upper end contact section 28, a separated section 27, which is positioned in an area corresponding to the small-diameter section 24 and separated from the inner circumferential surface of the outer opening section 4, is provided on the outer circumferential surface of the inner opening section 17.

Further, in the synthetic resin-made multilayer bottle 1 of the present embodiment, at least a part of an area of the outer circumferential surface of the lower end area of the inner opening section 17 excluding the area where the air passage 23 is formed is provided with a lower end contact section 29, which is in contact with the inner circumferential surface of the outer opening section 4.

In order to comply with the specifications of PCO1810 standard opening section, the outside diameter of the outer opening section 4 is set to 24 mm (or 27.45 mm when the external thread section 10 is included), the inner diameter thereof is set to 21.6 mm, and the height thereof is set to 21.01 mm, and the outside diameter of the support ring 11 is set to 31.6 mm.

The inner circumferential surface of the inner opening section 17 has the small-diameter section 24, the diameter of which is smaller than the inner diameter of the opening end of the inner opening section 17. The inner diameter of the opening end of the inner opening section 17 is set to 17.6 mm, and the inner diameter of the small-diameter section 24 is set to 14.7 mm. Further, the height of the inner opening section 17 is set to 24.01 mm.

The synthetic resin-made multilayer bottle 1 can be manufactured by, for example, placing an inner preform for forming the inner container body 3 inside an outer preform for forming the outer shell bottle 2, and blow-molding these preforms. The blow molding can be performed according to a well-known method by using a well-known blow molding apparatus.

Further, in the synthetic resin-made multilayer bottle 1 of the present embodiment, when the inner container main body 18 is deformed by an external pressure and the volume of the inner container body 3 reaches a minimum, a dead space, which cannot be thoroughly eliminated from the inner container main body 18, appears in the vicinity of the inner opening section 17 and in the vicinity of the recess section 8. Further, in the synthetic resin-made multilayer bottle 1 of the present embodiment, the volume of the inner opening section 17 is set such that the total of the volume of the dead space and the volume of the inner opening section 17 is 10% or less of the volume of the inner container body 3 before the inner container main body 18 is deformed by the external pressure. The volume of the inner opening section 17 of the present embodiment is 5.3 ml, which is equivalent to 1.06% in the case of a 500-ml synthetic resin-made multilayer bottle.

If, for example, the amount of content of the synthetic resin-made multilayer bottle 1 is 500 ml, then setting is preferably made such that the dead space of the synthetic resin-made multilayer bottle 1 will be 50 ml or less, and the volume of the inner opening section 17 that is not reduced by deformation is preferably set to be a minimum possible level, preferably 2.5 ml to 7.5 ml (0.5% to 1.5%) in the present embodiment. By setting the volume of the inner opening section 17 as described above, the dead space in the inner opening section 17 can be reduced, and the inner diameter required for inserting a rod, a nozzle or the like into the inner opening section 17 can be secured when blow molding the synthetic resin-made multilayer bottle 1.

According to the synthetic resin-made multilayer bottle 1 of the present embodiment, the volume of the inner opening section 17 can be reduced without reducing the outer diameter of the outer opening section 4, thus making it possible to reduce the dead space by reducing the volume of the inner opening section 17 while maintaining the diameter of the outer opening section 4 compliant with specifications.

In addition, the open end of the inner opening section 17 is formed to be larger than the small-diameter section 24, so that even when the volume of the inner opening section 17 is reduced, a rod or nozzle for blow molding or a charging nozzle for charging a content can be easily inserted into the inner opening section.

Further, in the present embodiment, the inner circumferential surface of the inner opening section 17 has the small-diameter section 24, the diameter of which is smaller than the inner diameter of the open end of the inner opening section 17, the inner diameter of the open end of the inner opening section 17 is set to 17.6 mm, and the inner diameter of the small-diameter section 24 is set to 14.7 mm. This makes it possible to provide the synthetic resin-made multilayer bottle 1 having a smaller dead space and to easily insert a nozzle for charging a content into the synthetic resin-made multilayer bottle 1. Further, in the present embodiment, the height of the inner opening section 17 is set to 24.01 mm.

In addition, the separated section 27 is provided at a position in the area corresponding to the small-diameter section 24 and between the outer circumferential surface of the inner opening section 17 and the inner circumferential surface of the outer opening section 4, thereby spacing the separated section 27 farther inward than the air passage 23 in the radial direction with respect to the inner circumferential surface of the outer opening section 4. This makes it possible to form a hollow space other than the air passage 23 to be relatively large, and to reduce the amount of a resin of the inner opening section 17, thus enabling a reduction in total cost of the synthetic resin-made multilayer bottle 1. Further, the upper end contact section 28 of the inner opening section 17 is in contact with the inner circumferential surface of the outer opening section 4, so that the inner opening section 17 can be stably fixed.

Further, the volume of the inner opening section 17 can be reduced with little reduction of the outer diameter of the outer opening section 4. Hence, as compared with the case where the outer opening section 4 is formed to have a small diameter as with the inner opening section 17, the outer diameter of the outer opening section 4 can be maintained at an appropriate dimension, thus making it easy to open and close a cap to be screwed onto the outer opening section 4.

Further, a charging nozzle is inserted into the inner opening section 17 to fill the synthetic resin-made multilayer bottle 1 with a content. When it is necessary to increase the inner diameter of the inner opening section 17 to enable a charging nozzle with a different diameter to be inserted into the inner opening section 17, this can be accommodated simply by changing the design of the inner opening section 17 by the small-diameter section 24 without the need for changing the shape of the outer opening section, thus enhancing the versatility of the outer shell bottle.

Further, in the synthetic resin-made multilayer bottle 1 of the present embodiment, at least a part of the area of the outer circumferential surface of the lower end area of the inner opening section 17 excluding the area where the air passage 23 is formed is provided with the lower end contact section 29, which is in contact with the inner circumferential surface of the outer opening section 4. The lower end contact section 29 being in contact with the inner circumferential surface of the outer opening section 4 enables the inner opening section 17 to be stably fixed.

In the present embodiment, the part of the shoulder section 5 that is in contact with the outer opening section 4 is formed of the quadrangular pyramid-shaped section 12, and the part of the bottom section 7 that is in contact with the ground contact section 9 is formed of the quadrangular pyramid-shaped section 15. Alternatively, however, the part of the shoulder section 5 that is in contact with the outer opening section 4 and the part of the bottom section 7 that is in contact with the ground contact section 9 may be polygonal pyramid-shaped or conical.

Further, in the present embodiment, the circumferential groove parts 6*a* and 6*b* are provided at the top and the bottom of the body section 6. Alternatively, however, a stepped part, the diameter of which gradually decreases toward the body section 6 from the shoulder section 5, may be provided in place of the circumferential groove part 6*a*, and a stepped part, the diameter of which gradually decreases toward the body section 6 from the bottom section 7, may be provided in place of the circumferential groove part 6*b*. Providing the synthetic resin-made multilayer bottle 1 of the present embodiment with the circumferential groove parts 6*a* and 6*b* or the stepped parts makes it possible to obtain an effect of reinforcing the upper and the lower parts of the body section 6 and also to further improve the squeezability of the body section 6 between the circumferential groove parts 6*a* and 6*b* or the stepped parts.

Further, the inner opening section 17 is shaped to have a maximum outer diameter of 21.6 mm, a maximum inner diameter of 17.6 mm, a minimum inner diameter of 14.7 mm, and a height of 24.01 mm; however, the dimensions of the inner opening section 17 of the present invention are not limited thereto. The inner opening section 17 may have other dimensions insofar as the dead space is equal to or smaller than the head space, the volume of the inner opening section ranges from 0.5% to 1.5% such that the total volume (minimum volume) of the volume of the dead space in the inner container main body when the inner container main body is deformed by an external pressure and the volume thereof reaches a minimum level and the volume of the inner opening section becomes 10% or less with respect to the volume in the inner container body before the inner container body is deformed (initial volume), and the inner diameter is 19 mm or less and 9 mm or more, the height is 25 mm or less and 18 mm or more. If the inner diameter of the inner opening section exceeds 19 mm or the height exceeds 25 mm, then it will be difficult to control the minimum volume to 10% or less of the initial volume.

Further, if the inner diameter of the inner opening section is smaller than 9 mm, then there is a possibility that a nozzle for charging a content cannot be inserted therein. Further, if the height of the inner opening section is below 18 mm, then it will be difficult to comply with the specifications of the PCO1810 standard opening section, which defines the standard specifications.

For example, in another embodiment illustrated in FIG. 4, the dimensions of the inner opening section are set such that the maximum outer diameter is 21.6 mm, the maximum inner diameter is 17.6 mm, the minimum inner diameter is 15.48 mm, and the height is 24.01 mm. The volume of the inner opening section illustrated in FIG. 4 is 6.1 ml, which is 1.2% in the case of a 500-ml synthetic resin-made multilayer bottle. Further, the small-diameter section of the inner opening section illustrated in FIG. 4 is located at a further lower position than the small-diameter section of the inner opening section illustrated in FIG. 3. The dimensions of the outer opening section illustrated in FIG. 4 are the same as the dimensions of the outer opening section 4 illustrated in FIG. 3.

Figure 5:
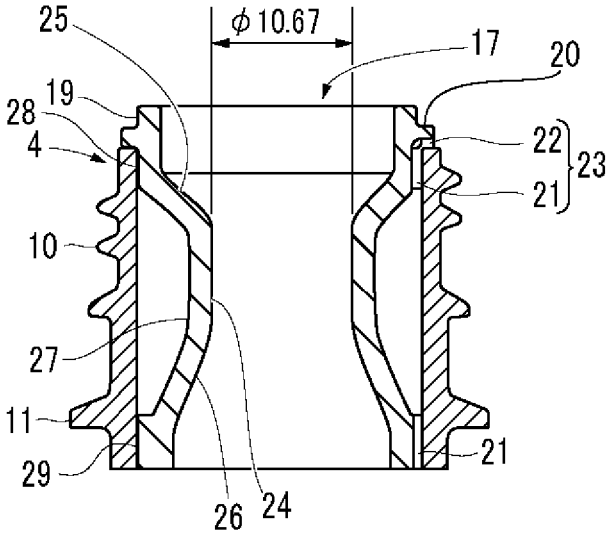
FIG. 5 is an enlarged sectional view illustrating an outer opening section and an inner opening section of a synthetic resin-made multilayer bottle of a third embodiment of the present invention.

Further, for example, the dimensions of the inner opening section in another embodiment illustrated in FIG. 5 are set such that the maximum inner diameter is 17.6 mm, the minimum inner diameter is 10.67 mm, and the height is 24.01 mm. The volume of the inner opening section illustrated in FIG. 5 is 4.3 ml, which is 0.9% in the case of a 500-ml synthetic resin-made multilayer bottle. The dimensions of the outer opening section illustrated in FIG. 5 are the same as the dimensions of the outer opening section 4 illustrated in FIG. 3.

Figure 6:
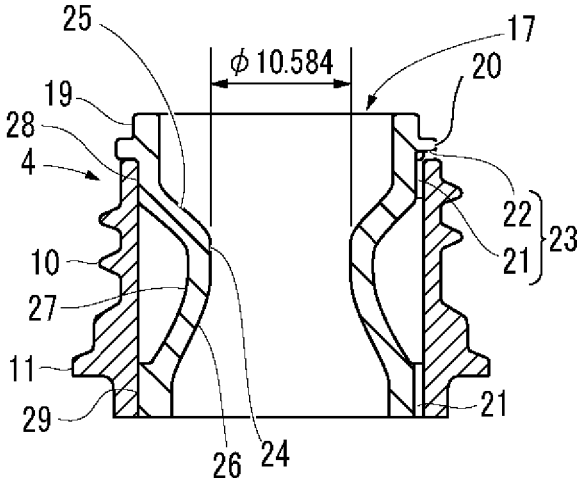
FIG. 6 is an enlarged sectional view illustrating an outer opening section and an inner opening section of a synthetic resin-made multilayer bottle of a fourth embodiment of the present invention.

Further, for example, the dimensions of the inner opening section in yet another embodiment illustrated in FIG. 6 are set such that the maximum inner diameter is 17.6 mm, the minimum inner diameter is 10.584 mm, and the height is 19.00 mm. The volume of the inner opening section illustrated in FIG. 6 is 3.7 ml, which is 0.7% in the case of a 500-ml synthetic resin-made multilayer bottle. The dimensions of the outer opening section illustrated in FIG. 6 are the same as the dimensions of the outer opening section 4 illustrated in FIG. 3.

Figure 7:
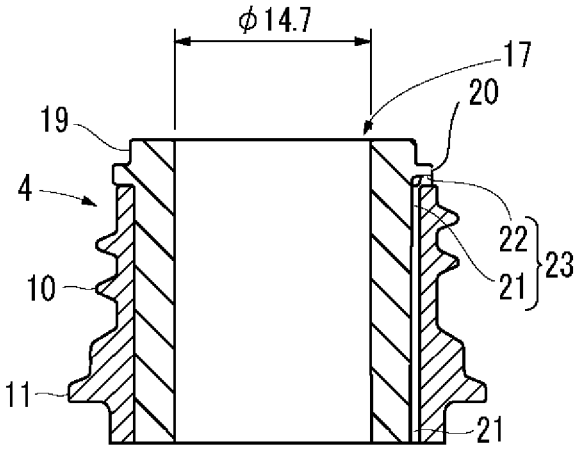
FIG. 7 is an explanatory diagram illustrating a synthetic resin-made multilayer bottle of a comparative example.

FIG. 7 illustrates, as a comparative example, a synthetic resin-made multilayer bottle in which an inner opening section is not provided with a small-diameter section. The dimensions of the outer opening section illustrated in FIG. 7 are the same as the dimensions of the outer opening section 4 illustrated in FIG. 7. As illustrated in FIG. 7, the volume of the inner opening section can be reduced also by reducing the inner diameter of the inner opening section as a whole. In this case, however, the opening of the upper end of the inner opening section inconveniently becomes smaller accordingly, making it difficult to insert a rod or nozzle into the inner opening section when blow molding the outer shell bottle and the inner container main body of the synthetic resin-made multilayer bottle, and also making it difficult to insert a charging nozzle into the inner opening section when charging a content into the synthetic resin-made multilayer bottle.

In the synthetic resin-made multilayer bottle 1 of the present embodiment, the small-diameter section 24 having a diameter that is smaller than the inner diameter of the open end of the inner opening section 17 is provided on the inner circumferential surface of the inner opening section 17, thus making it possible to reduce the volume of the inner opening section 17 and to make it easy to insert a rod or a nozzle for blow molding or a nozzle for charging a content into the inner opening section 17. In addition, the upper inclined surface 25 enables a rod or a nozzle to smoothly pass by the small-diameter section 24 without being caught by the inner circumferential surface of inner opening section 17 between the open end of the inner opening section 17 and the small-diameter section 24.

DESCRIPTION OF REFERENCE NUMERALS

1 synthetic resin-made multilayer bottle
2 outer shell bottle
3 inner container body
4 outer opening section
5 shoulder section
6 body section
7 bottom section
8 recess section
9 ground contact section
10 external thread section
11 support ring
12 quadrangular pyramid-shaped section
13 body upper section
14 vertical rib
15 quadrangular pyramid-shaped section
16 body lower section
17 inner opening section
18 inner container main body
19 extension section
20 flange section
21 vertical groove
22 horizontal groove
23 air passage
24 small-diameter section
25 upper inclined surface
26 lower inclined surface
27 separated section
28 upper end contact section
29 lower end contact section

The invention claimed is:

1. A synthetic resin-made multilayer bottle comprising:

a synthetic resin-made outer shell bottle which has a cylindrical outer opening section, a shoulder section continuing from the outer opening section, a body section continuing from the shoulder section, and a bottom section continuing from the body section, and which can restore an original shape thereof with respect to an external pressure;

a synthetic resin-made inner container body which has a cylindrical inner opening section provided inside the outer opening section of the outer shell bottle, and an inner container main body which continues from the inner opening section, which is shaped along an inner surface shape of the outer shell bottle, and which deforms in response to an external pressure; and an air passage which is formed between the outer opening section and the inner opening section and which introduces outside air between the outer shell bottle and the inner container body, wherein:

a small-diameter section, having a diameter that is smaller than an inner diameter of an open end of the inner opening section, is provided on an inner circumferential surface of the inner opening section, an upper end contact part, that is in contact with an inner circumferential surface of the outer opening section, is provided at an upper end outer circumferential surface of the inner opening section, a lower end contact part, that is in contact with the inner circumferential surface of the outer opening section, is provided at a lower end outer circumferential surface of the inner opening section, and a separated part, which is formed between the upper end contact part and the lower end contact part and spaced away from the inner circumferential surface of the outer opening section, is provided on the outer circumferential surface of the inner opening section, and positioned in an area, which corresponds to the small-diameter section, at the bottom of the upper end contact part.

2. The synthetic resin-made multilayer bottle according to claim 1, wherein the separated part is spaced away farther inward in a radial direction than the air passage.

* * * * *